US008894056B2

(12) United States Patent
Oshima

(10) Patent No.: US 8,894,056 B2
(45) Date of Patent: Nov. 25, 2014

(54) SHEET PROCESSING DEVICE AND IMAGE FORMING SYSTEM

(71) Applicant: Keisuke Oshima, Kanagawa (JP)

(72) Inventor: Keisuke Oshima, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/711,732

(22) Filed: Dec. 12, 2012

(65) Prior Publication Data

US 2013/0154176 A1 Jun. 20, 2013

(30) Foreign Application Priority Data

Dec. 15, 2011 (JP) ..... 2011-274618

(51) Int. Cl.
*B65H 39/00* (2006.01)

(Continued)

(52) U.S. Cl.
CPC ..... *B65H 39/00* (2013.01); *B65H 29/60* (2013.01); *B65H 31/3045* (2013.01); *B65H 37/04* (2013.01); *B65H 37/06* (2013.01); *B65H 39/10* (2013.01); *G03G 15/6544* (2013.01); *B65H 45/30* (2013.01); *B65H 2301/322* (2013.01); *B65H 2301/33222* (2013.01); *B65H 2301/4213* (2013.01); *B65H 2301/4421* (2013.01); *B65H 2301/45* (2013.01); *B65H 2404/725* (2013.01); *B65H 2404/73* (2013.01); *B65H 2408/12* (2013.01); *B65H 2511/11* (2013.01); *B65H 2511/20* (2013.01); *B65H 2701/18271* (2013.01); *B65H 2701/1829* (2013.01); *B65H 2701/18292* (2013.01); *B65H 2801/27* (2013.01); *G03G 2215/00831* (2013.01); *B65H 2701/13212* (2013.01); *B42C 1/12* (2013.01)
USPC ..... 270/52.26; 270/52.18; 270/52.29; 270/52.3; 270/52.14; 270/32

(58) Field of Classification Search
USPC ..... 270/32, 37, 52.14, 52.17, 52.18, 52.26, 270/52.29, 52.3, 58.07, 58.08
See application file for complete search history.

(56) References Cited

U.S. PATENT DOCUMENTS 6,095,740 A * 8/2000 Hollenstein et al. ..... 412/4
6,805,340 B2 * 10/2004 Silberbauer ..... 270/38
7,261,507 B2 * 8/2007 Horii et al. ..... 412/35

FOREIGN PATENT DOCUMENTS

JP 2005-096913 4/2005
JP 2006-036402 2/2006

OTHER PUBLICATIONS

Japanese Office Action, Notice of Reasons for Rejection for JP2011-274618 with English translation. Dispatch date: Feb. 12, 2014.

*Primary Examiner* — Leslie A Nicholson, III
(74) *Attorney, Agent, or Firm* — Lucas & Mercanti, LLP

(57) ABSTRACT

Sheets center-folded by a center-folder are placed on a main saddle. A buffer saddle is provided separately from the main saddle, on an opposite side of the center-folder across the main saddle. The pile of sheets saddle-stitched on the main saddle is placed on the buffer saddle. When viewed from above, the buffer saddle is movable in a direction separating from the main saddle that is a reverse direction to the center-folder, and in a direction orthogonal to the direction separating from the main saddle. A sheet processing device is arranged in the orthogonal direction where the buffer saddle is movable.

6 Claims, 19 Drawing Sheets

(51) Int. Cl.

| | |
|---|---|
| ***B65H 29/60*** | (2006.01) |
| ***B65H 31/30*** | (2006.01) |
| ***B65H 37/04*** | (2006.01) |
| ***B65H 37/06*** | (2006.01) |
| ***B65H 39/10*** | (2006.01) |
| ***G03G 15/00*** | (2006.01) |
| ***B65H 45/30*** | (2006.01) |
| *B42C 1/12* | (2006.01) |

SHEET PROCESSING DEVICE AND IMAGE FORMING SYSTEM

CROSS REFERENCE TO RELATED APPLICATIONS

This application is entitled to and claims the benefit of Japanese Patent Application No. 2011-274618, filed on Dec. 15, 2011, the disclosure of which including the specification, drawings and abstract is incorporated herein by reference in its entirety.

BACKGROUND OF THE INVENTION

1. Field of the Invention

The present invention relates to a sheet processing device performing a process such as a sheet saddle-stitching process and an image forming system including the sheet processing device.

2. Description of Related Art

Conventionally, devices have been used that perform a sheet processing including sheet center-folding process and sheet saddle-stitching process.

Japanese Patent Application Laid-Open No. 2005-96913 discloses technology that changes the posture of a sheet, and then performs a center-folding process and a saddle-stitching process. In Japanese Patent Application Laid-Open No. 2005-96913, a manner of changing the sheet posture so as to achieve rapid and reliable changes in sheet posture with respect to various sheet sizes has been proposed.

Japanese Patent Application. Laid-Open No. 2006-36402 discloses a device that achieves feeding of a pile of sheets placed on a saddle while preventing feeding troubles or crinkles even when the pile includes a large number of sheets.

On the other hand, the device disclosed in Japanese Patent Application Laid-Open No. 2005-96913 changes the posture of a sheet three times. Accordingly, because a mechanism for changing the posture of the sheet is complicated and extra space is required to change the posture of the sheet, it is thought that the device is more susceptible to increase in size.

The device disclosed in Japanese Patent Application Laid-Open No. 2006-36402 lifts up the pile of sheets (booklet) that have been saddle-stitched on the saddle and feeds the pile of sheets to a subsequent processor. Such a configuration requires a complicated mechanism for feeding the pile of sheets, resulting in complication and an increase in the size of the entire device.

SUMMARY OF THE INVENTION

An object of the present invention is to provide a sheet processing device having a simple configuration and a small size, and an image forming system.

To achieve the abovementioned object, a sheet processing device reflecting one aspect of the present invention includes: a first saddle on which sheets center-folded by a center-folder are to be placed; a second saddle that is provided separately from the first saddle on an opposite side of the center-folder across the first saddle, allows a pile of sheets saddle-stitched on the first saddle to be placed thereon, and is movable in a direction separating from the first saddle that is a reverse direction to the center-folder and in a direction orthogonal to the direction separating from the first saddle, viewed from above; and; a post processor that is arranged in the orthogonal direction where the second saddle is movable, and performs a post-processing on the pile of sheets.

An image forming system reflecting another aspect of the present invention includes: an image forming unit that forms an image on a sheet; and the sheet processing device that receives the sheet on which the image is formed by the image forming unit.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be specifically described based on the accompanying drawings.

(1) Overall Configuration of System

Figure 1:
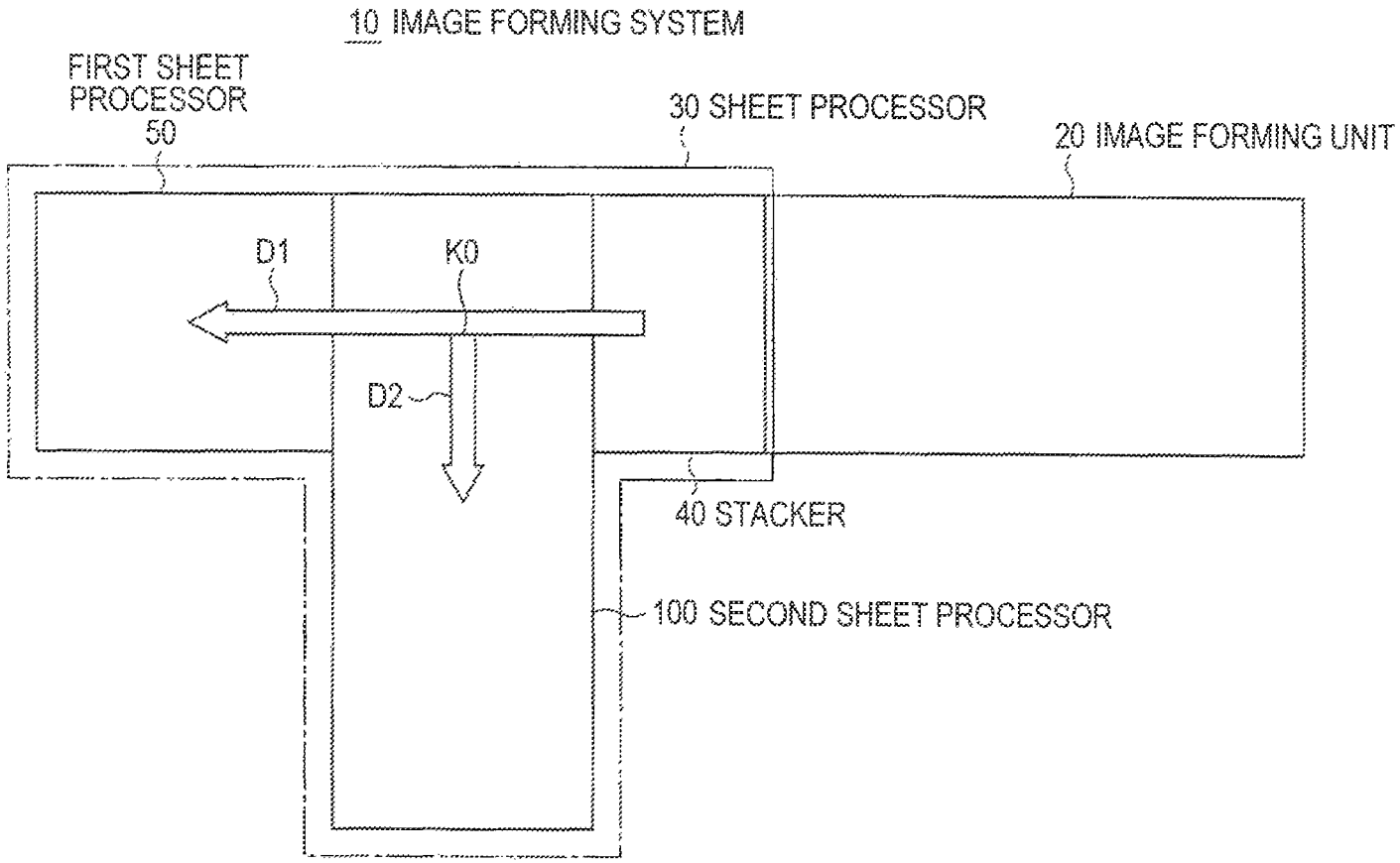
FIG. 1 is a schematic plan view showing an overall configuration of an image forming system that uses a sheet processing device of an embodiment.
Figure 2:
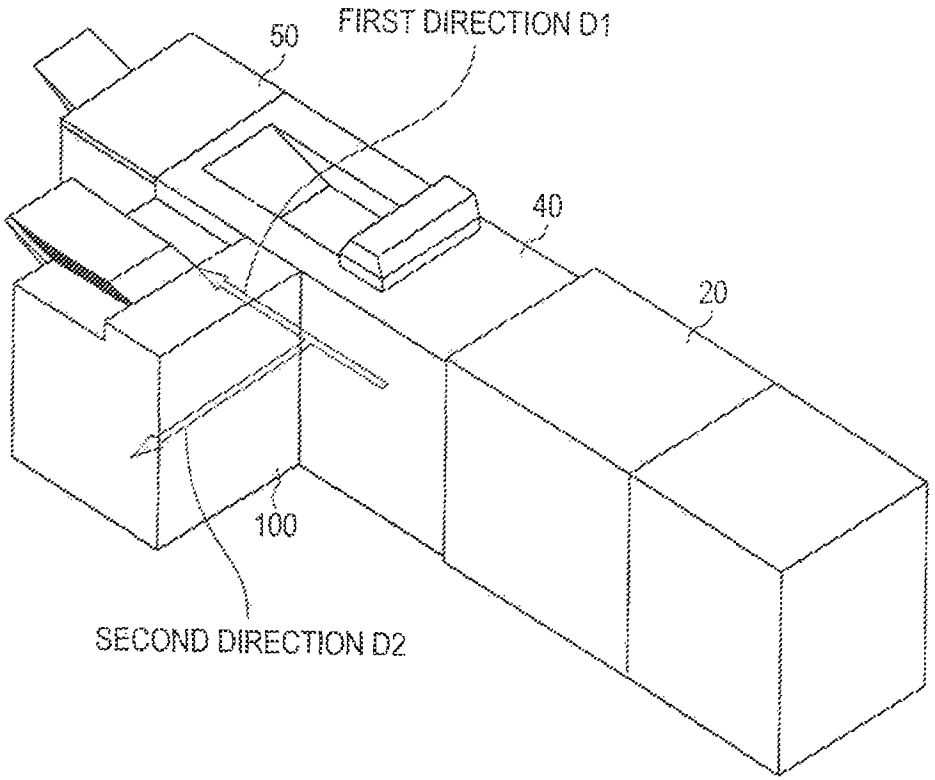
FIG. 2 is a schematic perspective view showing an exterior configuration of the image forming system.

FIG. 1 is a schematic plan view showing an overall configuration of an image forming system that uses a sheet processing device of an embodiment. FIG. 2 is a schematic perspective view showing an exterior configuration of the image forming system.

As shown in FIG. 1, image forming system 10 includes image forming unit 20 and sheet processor 30.

Image forming unit 20 forms an image which is a toner image on a sheet, and is the part referred to as a copy machine or a printer. Image forming unit 20 includes a scanner, an exposure device, a photoconductive drum, a developing device, and a fixing device, and/or the like, and is for forming a toner image on a sheet and ejecting the sheet on which the toner image has been formed.

Sheet processor 30 includes stacker 40, first sheet processor 50, and second sheet processor 100.

Sheet processor 30 is able to feed a sheet which has been fed thereinto (i.e., a printed sheet ejected from image forming unit 20) while switching to any one of first direction D1 which is the same direction as the feed-in direction of the sheet and second direction D2 which is orthogonal to first direction D1.

First sheet processor 50 is arranged in first direction D1. Second sheet processor 100 is arranged in second direction D2. In addition, second sheet processor 100 includes a common path forming feeding branch point K0 of first sheet processor 50 and second sheet processor 100. In other words, a printed sheet is fed into first sheet processor 50 via a part of second sheet processor 100.

First sheet processor 50 executes a process other than center-folding on the sheet. First sheet processor 50 is a sheet ejection tray, a side stitching stapler, a hole puncher, a case bookbinding (a glue binding) machine, and/or the like, which executes a bulk-loading process a side-stitching process, a hole-punching process, a case bookbinding process, and/or the like, on printed sheets. Moreover, the configuration of first sheet processor 50 is not limited to one which executes a process mentioned above, and thus may execute another process other than center-folding.

Figure 3:
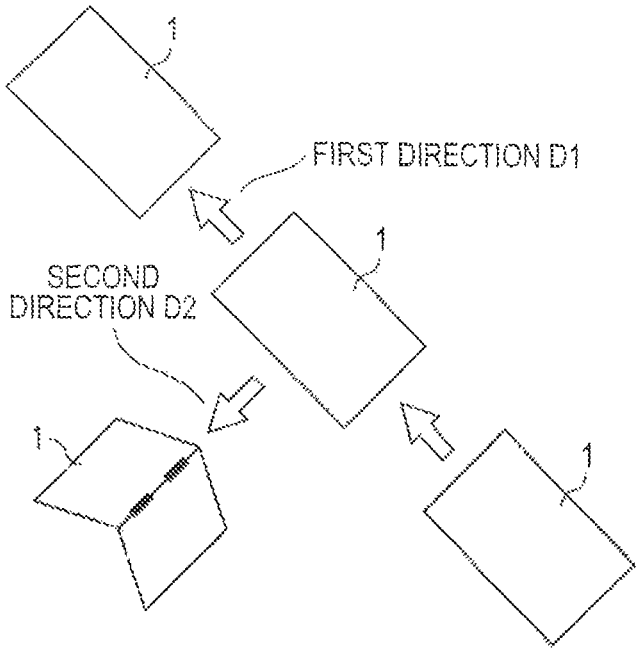
FIG. 3 is a diagram showing the state of a sheet fed in a first direction and the state of a sheet fed in a second direction.

Second sheet processor 100 executes a process including a center-folding process on the sheet. FIG. 3 shows the state of sheet 1 that is fed in any one of first direction D1 and second direction D2. Sheet 1 that is fed in first direction D1 is a sheet which has not been center-folded, and sheet 1 that is fed in second direction D2 is the sheet which has been center-folded. In the case of the present embodiment, second sheet processor 100 sequentially executes the center-folding process, a saddle-stitching process, a cutting process, and a loading process on sheet 1. The detailed configuration of second sheet processor 100 will be described hereinafter.

Stacker 40 stacks thereon a predetermined number of sheets, and ejects the sheets in the direction of the arrow shown in the drawings, namely, toward feeding branch point K0 (may also be referred to as "toward second sheet processor 100"). For example, five sheets stacked by stacker 40 are thereby simultaneously center-folded by second sheet processor 100. Moreover, providing stacker 40 allows for printed sheets to be stocked in stacker 40 (i.e., stacker 40 functions as a buffer) even when time is needed in first sheet processor 50 and second sheet processor 100 after stacking, so that the processing of image forming unit 20 in the previous stage does not have to be stopped and a reduction in productivity can be prevented.

(2) Configuration of Second Sheet Processor (2-1) Feeder Mechanism of Common Path and Center-Folding Mechanism Second sheet processor 100, a feeder mechanism of a common path including branch point K0 in FIG. 1, and a center-folding mechanism will be specifically described.

Figure 4:
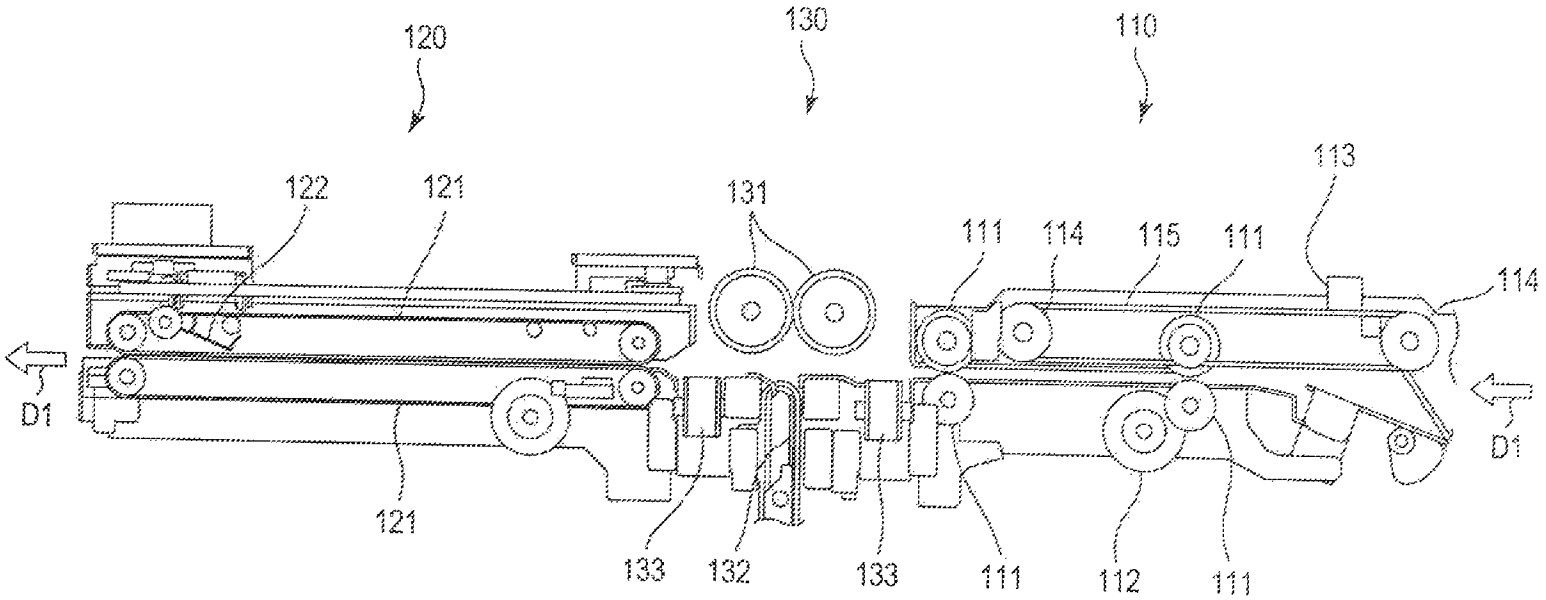
FIG. 4 is a side view showing a configuration for a feeder mechanism and for a center-folding mechanism at a common path.

FIG. 4 is a diagram showing a configuration for a feeder mechanism and for a center-folding mechanism at a common path, FIG. 4 is a side view showing second sheet processor 100 along arrow D1 in FIG. 1. In other words, in FIG. 4, stacker 40 is arranged on the right, first sheet processor 50 is arranged on the left, and second direction D2 runs toward the viewer of this drawing.

The feeder mechanism in FIG. 4 is mainly divided into sheet in-feeder 110, sheet out-feeder 120, and center-folder 130.

Sheet in-feeder 110 includes a pair of top and bottom feeder rollers 111. A sheet is sandwiched between feeder rollers 111, and is fed in first direction by the torque of feeder rollers 111. Additionally, feeder rollers 111 are driven by drive gear 112.

Sheet in-feeder 110 includes biasing member 113. Biasing member 113 is fixed on the surface of timing belt 115 extended between drive pulleys 114, and is movable along with timing belt 115 in a clockwise direction and an anti-clockwise direction in the drawing.

Sheet out-feeder 120 includes a pair of top and bottom feeder belts 121. A sheet is sandwiched between top and bottom feeder belts 121, and is fed in first direction D1 by the torque of feeder belts 121. A plurality of feeder belts 121 are arranged next to each other at predetermined intervals in a direction orthogonal to the of this drawing plane (refer to FIG. 10 for the arrangement of feeder rollers 111 and feeder belts 121).

Sheet out-feeder 120 includes front-end regulation member 122. Front-end regulation member 122 abuts against the front end of the sheet, and regulates the sheet front-end position. Furthermore, front-end regulation member 122 can enter and withdraw from a feeding path. FIG. 4 shows a state where front-end regulation member 122 is retracted from the feeding path. Furthermore, front-end regulation member 122 is movable in first direction D1 or in the opposite direction according to the size of the sheet that is fed thereinto.

Center-folder 130 includes two nip rollers 131, and thin-plate folding knife 132 for pushing the sheet between nip rollers 131. The rotational axis of nip rollers 131 is parallel to the rotational axes of feeder rollers 111 and drive gear 112. Both feeder rollers 111 and nip rollers 131 can be driven by drive gear 112. Accordingly, the driving source for sheet feeding and center-folding is easily shared by configuring second sheet processor 100 to include a common feeding path which forms a branch point of the feeding path in first direction 131 and the feeding path in second direction D2, and executing the center-folding process at the common feeding path. Moreover, a nip line of nip rollers 131 is orthogonal to first direction D1. Specifically, the nip line is formed in the direction orthogonal to the plane of the drawing.

The main operations performed by the feeder/center-folding mechanisms are as follows:

(i) Sheet Feed-in Operation (ii) Sheet Positioning Operation (iii) Center-folding Operation (iv) Sheet Ejection Operation in First Direction D1

(v) Sheet Ejection Operation in Second Direction D2

Hereinafter, each operation will be specifically described.

(i) Sheet Feed-In Operation

As shown in FIG. 4, top and bottom feeder rollers 111 are driven in a contact state, and top and bottom feeder belts 121 are driven in a contact state. The sheet is sandwiched between top and bottom feeder rollers 111 and top and bottom feeder belts 121, and is fed in first direction D1. This sheet feeding operation ends slightly before the center of the sheet reaches folding knife 132.

(ii) Sheet Positioning Operation

Figure 5:
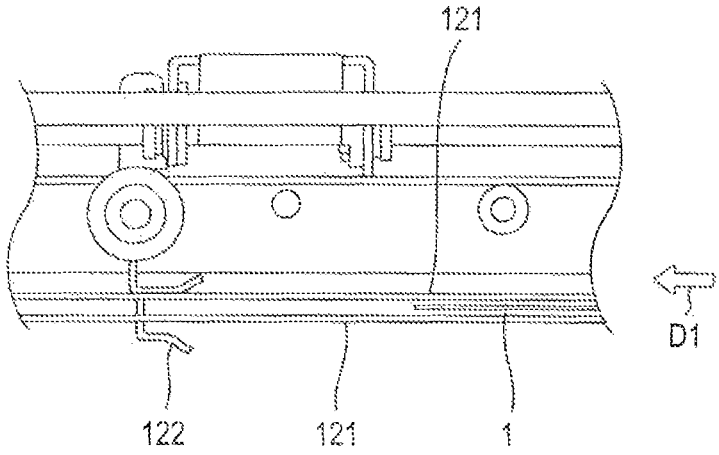
FIG. 5 is a side view showing a state of a front-end regulation member and a feeder belt at the time of sheet positioning.
Figure 6:
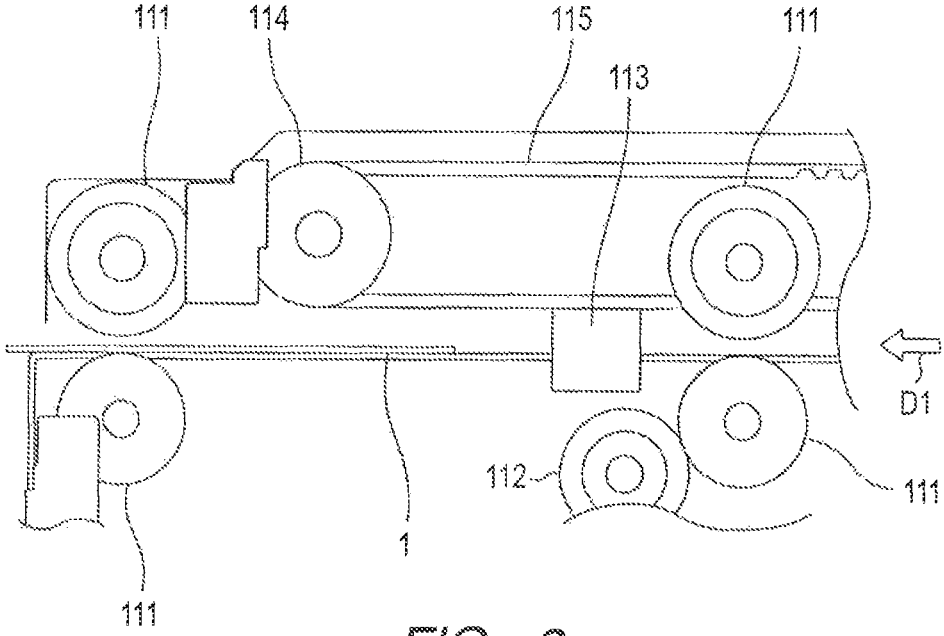
FIG. 6 is a side view showing a state of a biasing member and a feeder roller at the time of sheet positioning.

A sheet positioning operation is performed as preprocessing when the center-folding process is executed. As shown in FIG. 5, top and bottom feeder belts 121 are separated, and front-end regulation member 122 protrudes in front of sheet 1. Furthermore, as shown in FIG. 6, top and bottom feeder rollers 111 are separated. Because feeder belts 121 and feeder rollers 111 are separated in this manner, sheet 1 is released in first direction D1. In this state, timing belt 115 is rotated in the clockwise direction in the drawing by drive pulleys 114. Accordingly, biasing member 113 pushes the rear end of sheet 1, and biases the front end of sheet 1 toward front-end regulation member 122. Drive pulleys 114 stop and the positioning of sheet 1 is ended when the front end of sheet 1 reaches front-end regulation member 122. The protrusion position of front-end regulation member 122 in first direction D1 and the stop position of biasing member 113 (also referred to as the interval between front-end regulation member 122 and biasing member 113) are set according to the size of sheet 1 that is fed thereinto. In other words, the protrusion position of front-end regulation member 122 and the stop position of biasing member 113 are set based on the size of sheet 1 such that the center of sheet 1 is positioned at the position of folding knife 132.

(iii) Center-Folding Operation

Figure 7:
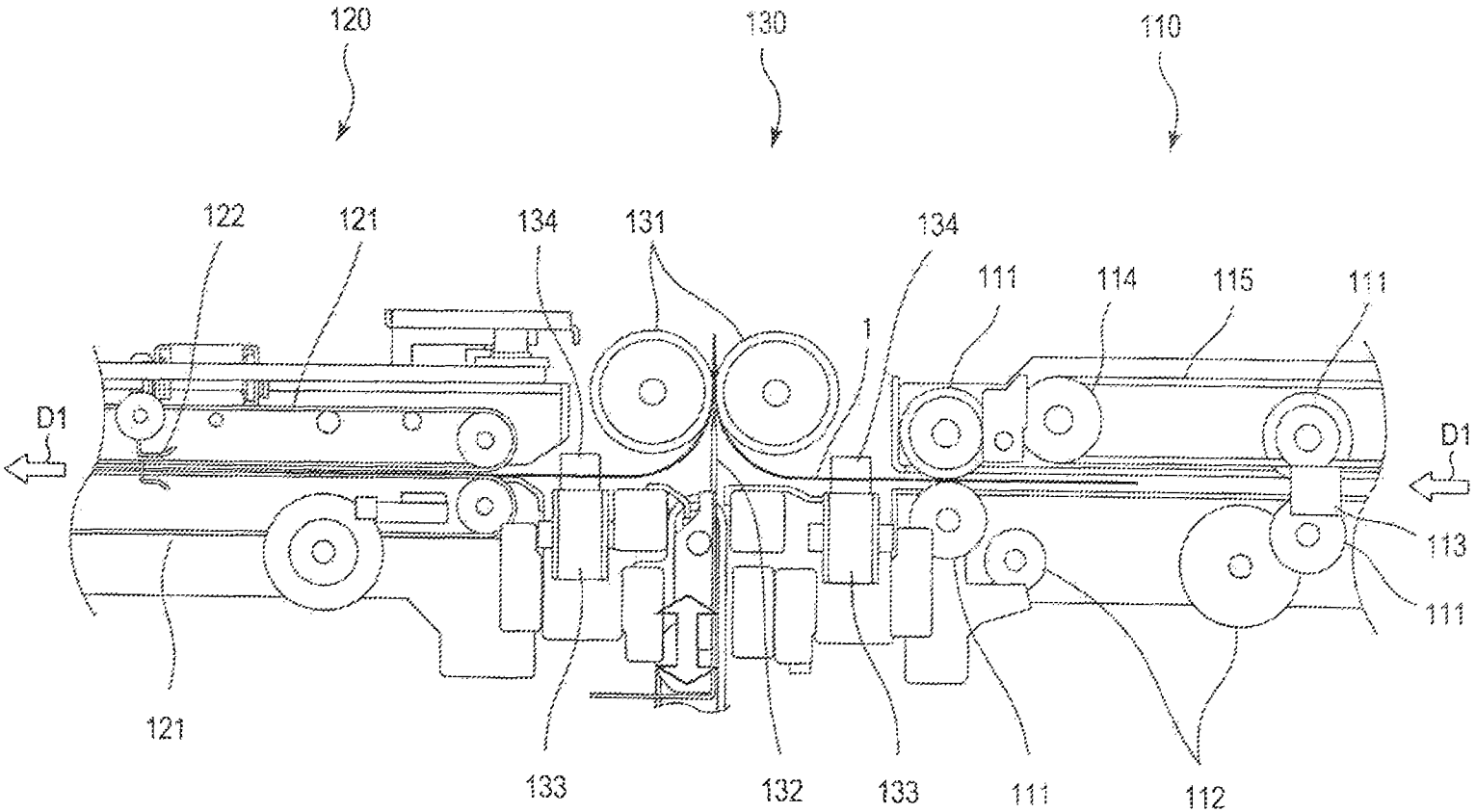
FIG. 7 is a side view showing a state of the feeder mechanism and the center-folding mechanism at the time of center-folding.

FIG. 7 is a diagram showing a state at the time of center-folding operation. As shown in FIG. 7, similar to the sheet positioning operation, folding knife 132 moves upward while top and bottom feeder belts 121 and top and bottom feeder rollers 111 are in a separated state (i.e., sheet 1 is in a released state). Accordingly, sheet 1 is pushed into nip rollers 131. Nip rollers 131 rotate until sheet 1 upwardly protrudes from the nip position, thereby causing a fold to be formed in sheet 1 via the pressure force of nip rollers 131. Afterwards, nip rollers 131 rotate in a reverse direction so that the sheet, in which a fold has been formed, drops off from nip rollers 131 and is returned to the feeding path.

(iv) Sheet Ejection Operation in First Direction D1

Figure 8:
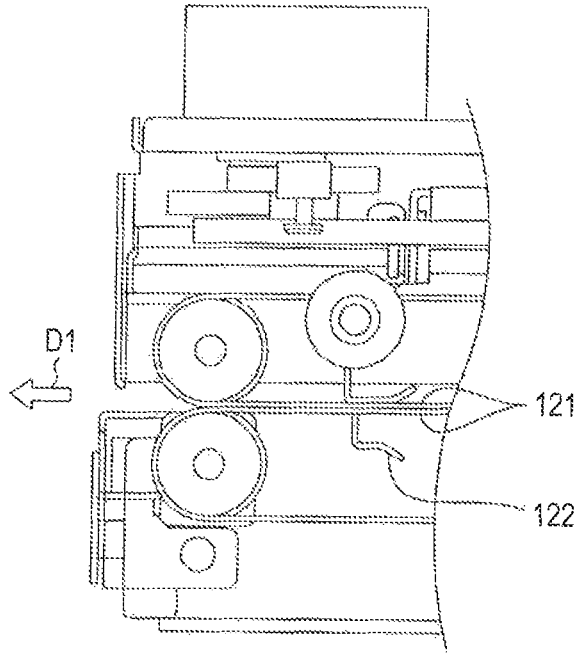
FIG. 8 is a side view showing the front-end regulation member in a protruded state.
Figure 9:
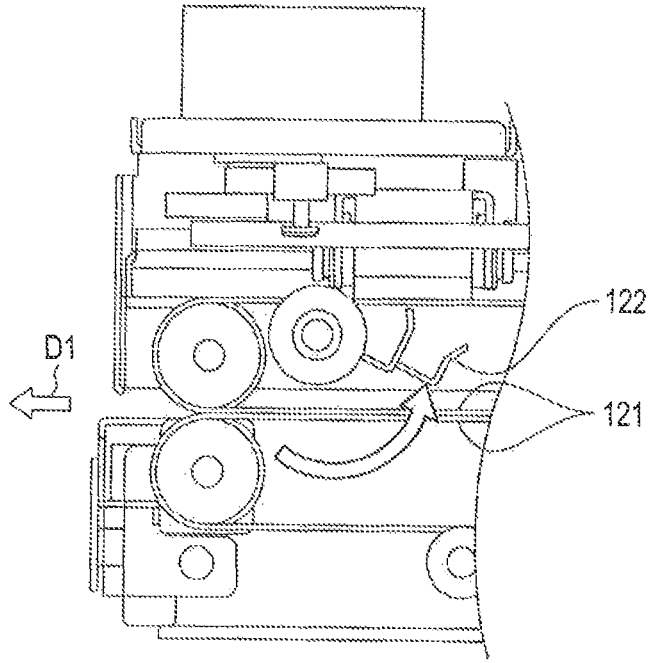
FIG. 9 is a side view showing the front-end regulation member in a retracted state.

When the sheet ejection operation is executed in first direction D1, the abovementioned sheet positioning operation and the center-folding operation are not executed, similarly to the sheet feeding operation, sheet 1 is sandwiched between top and bottom feeder rollers 111 and top and bottom feeder belts 121, fed in first direction D1, and ejected. At this time, it is impossible to eject the sheet with the front-end regulation member 122 staying in a protruded state such as shown in FIG. 8, and thus front-end regulation member 122 retracts from the feeding path and clears the feeding path in first direction D1 as shown in FIG. 9.

(v) Sheet Ejection Operation in Second Direction D2

Figure 10:
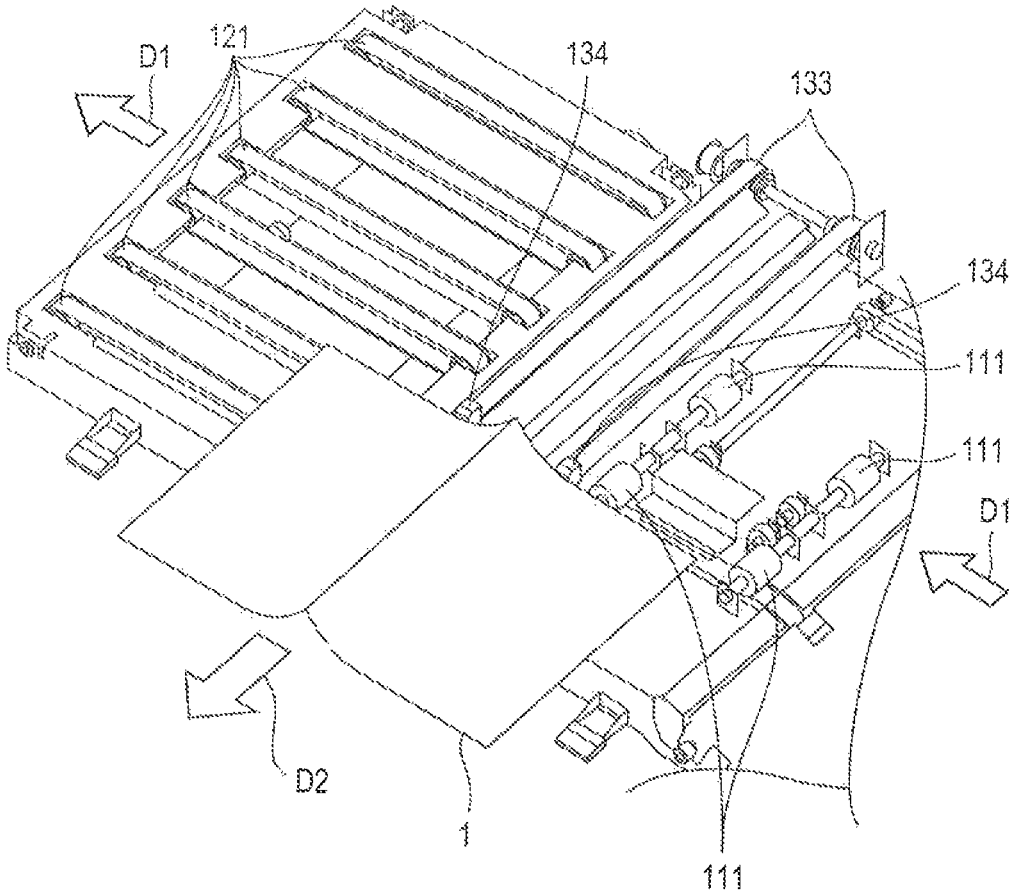
FIG. 10 is a diagram describing a sheet ejection operation in the second direction.
Figure 11:
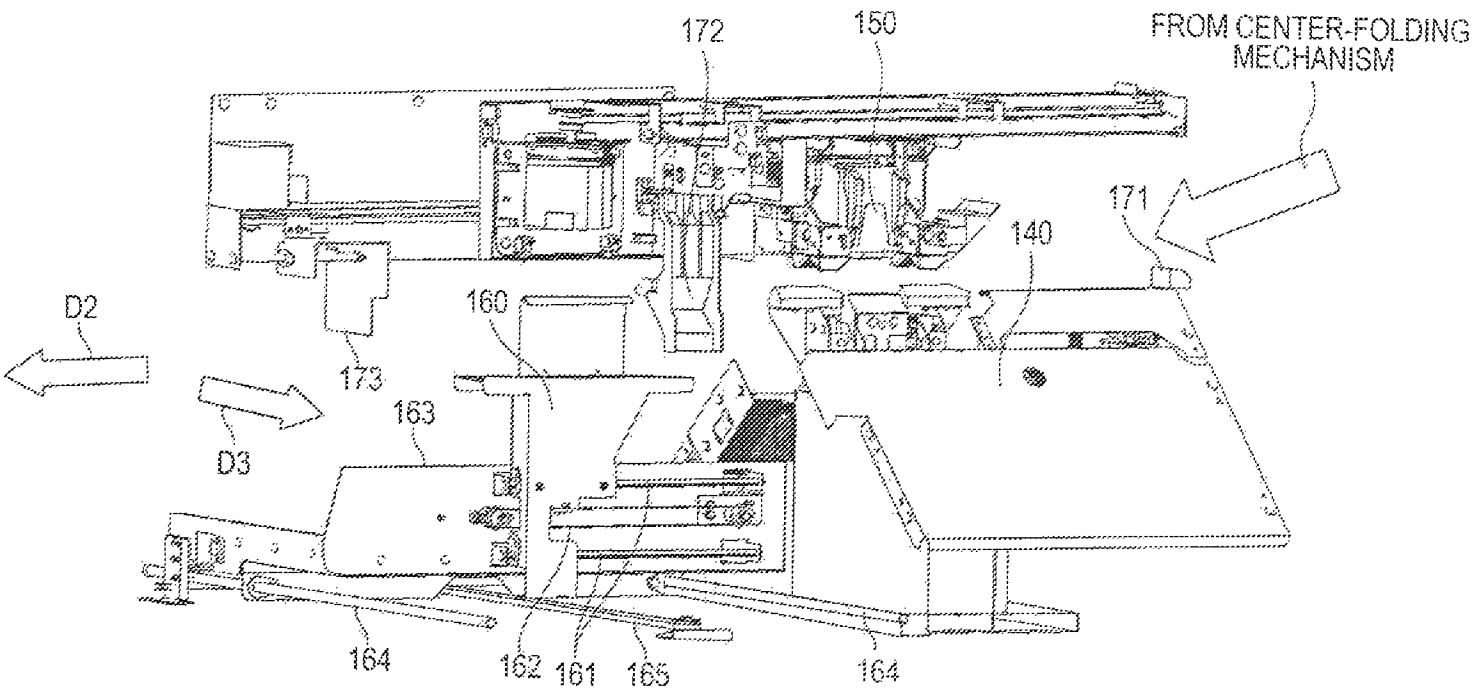
FIG. 11 is a perspective view showing configurations for a saddling mechanism and a saddle-stitching mechanism.

Sheet 1 in which a fold has been formed and which has been returned from nip rollers 131 to the feeding path is pushed in second direction D2 by pushing claw 134, as shown in FIG. 10. Pushing claw 134 is fixed to feeder belt 133, and is movable in second direction D2 together with feeder belt 133 in other words, pushing claw 134 moves in second direction. D2 while being abutted against a side of sheet 1 which has been center-folded, so that center-folded sheet 1 is pushed in second direction D2. Moreover, similar to the sheet positioning operation and the center-folding operation, the sheet pushing operation in second direction D2 is performed while top and bottom feeder belts 121 and top and bottom feeder rollers 111 are in a separated state (i.e., sheet 1 is in a released state), (2-2) Saddle and Saddle-stitching Mechanisms FIG. 11 is a perspective view showing a configuration of a saddling mechanism and a saddle-stitching mechanism of the present embodiment. The saddling and saddle-stitching mechanisms of the present embodiment, include main saddle (first saddle) 140, stapler 150, and buffer saddle (second saddle) 160.

Main saddle 140 has a triangular cross section so that the center-folded sheet can be stably placed on main saddle 140. Center-folded sheet 1 ejected from the abovementioned center-folding mechanism is fed to main saddle 140. Center-folded sheets 1 are placed on main saddle 140.

Stapler 150 is provided above main saddle 140, and descends toward main saddle 140 so as to saddle-stitch sheets placed on main saddle 140. Furthermore, the positions of main saddle 140 and stapler 150 are fixed with respect to second direction D2.

Buffer saddle 160 is provided separately from main saddle 140 and is movable with saddle-stitched sheets placed thereon. Main saddle 140 and buffer saddle 160 are serially arranged in the folding direction of center-folded sheets. Buffer saddle 160 is disposed on the opposite side of center-folder 130 across main saddle 140, and is movable in the direction separating from main saddle 140 (direction D2) and also in the direction approaching main saddle 140 (reverse direction to the direction D2).

Specifically, buffer saddle 160 is pivotally supported at slide shaft 161, and moved in second direction D2 and the opposite direction thereto by drive belt 162. Moreover, base 163 of buffer saddle 160 is pivotally supported at slide shaft 164, and moved in direction D3 orthogonal to second direction 132 and the opposite direction thereto by drive belt 165.

Saddle and saddle-stitching mechanisms include a feeder for feeding a pile of sheets placed on main saddle 140 toward buffer saddle 160 while keeping the pile of sheets on main saddle 140; and a positioner for abutting against the front end in the feeding direction of the pile of sheets fed by the feeder, so as to position the pile of sheets at the saddle-stitching position where a saddle-stitching is executed by stapler 150. In the present embodiment, the feeder is provided as first feeding member 171 and second feeding member 172, and the positioner is provided as positioning member 173.

As described in detail later, first feeding member 171 functions for feeding the sheets to be saddle-stitched to the saddle-stitching position where the saddle-stitching is executed by stapler 150, and also fitting the pile of sheets in place at this position, and second feeding member 172 functions for feeding the saddle-stitched pile of sheets onto buffer saddle 160. Second feeding member 172 also functions for positioning the pile of sheets at the saddle-stitching position where the saddle-stitching is executed by stapler 150, in other words, second feeding member 172 functions as both the feeder and the positioner.

First feeding member 171, second feeding member 172, and positioning member 173 are respectively movable in second direction D2 and the opposite direction thereof.

Figure 12:
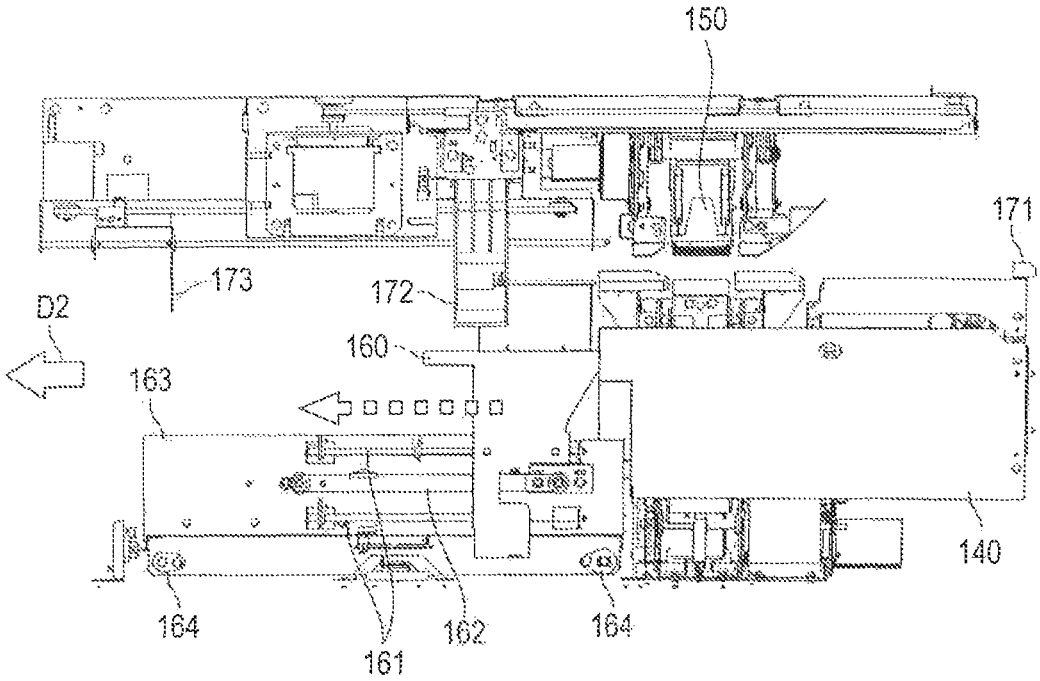
FIG. 12 is a side view showing a buffer saddle movement state.
Figure 13:
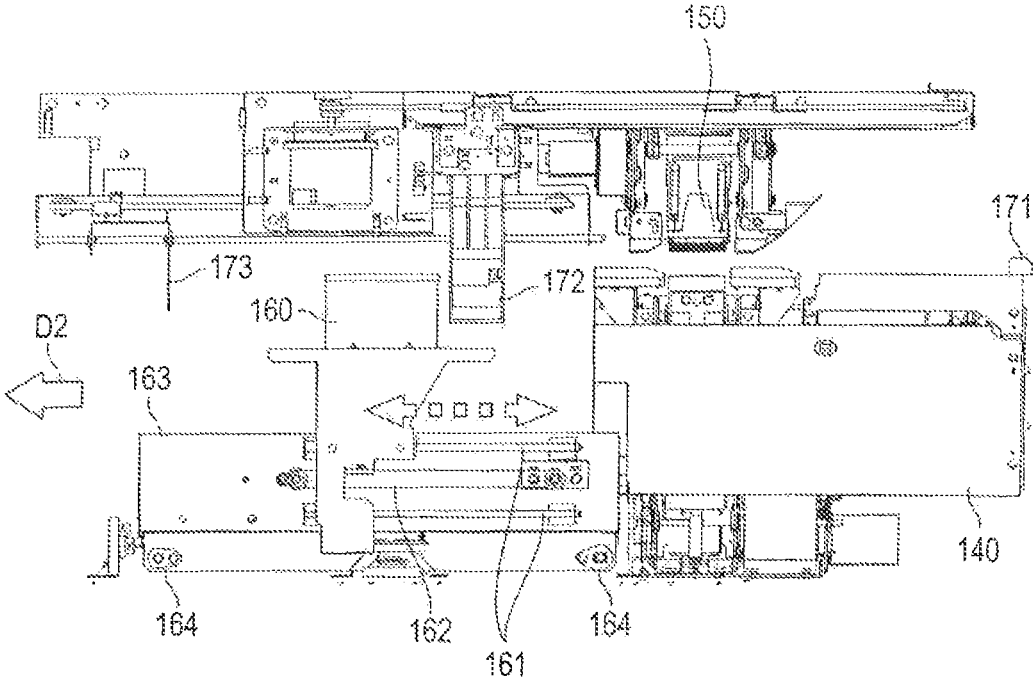
FIG. 13 is a side view showing a buffer saddle movement state.

FIGS. 12 and 13 show the movement of buffer saddle 160. FIG. 12 shows a state where buffer saddle 160 is nearest to main saddle 140, and thus saddle-stitching is executed by stapler 150 while in this state. FIG. 13 shows a state where buffer saddle 160 is farthest from main saddle 140 in second direction D2. Furthermore, when in the state shown in FIG. 13, a saddle-stitched pile of sheets is placed on buffer saddle 160. After buffer saddle 160 becomes a state which is the most separated from main saddle 140 in second direction D2, as shown in FIG. 13, buffer saddle 160 is moved in direction D3 (toward the viewer of FIG. 13) along slide shaft 164.

Next, an operation of the saddling mechanism and an operation of the saddle-stitching mechanism of the present embodiment will be described with reference to FIGS. 14A to 14E. FIGS. 14A to 14E are schematic views showing the saddling mechanism and the saddle-stitching mechanism from above.

Figure 14A:
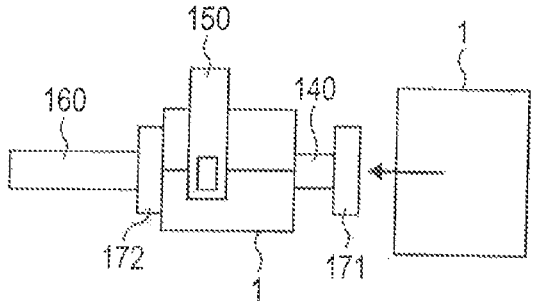
FIG. 14A is a top view describing an operation of the saddling mechanism and the saddle-stitching mechanism, and is a view showing a first state of the operation.

First, as shown in FIG. 14A, sheets 1 that are placed on main saddle 140 and center-folded have the front end position thereof regulated by second feeding member 172, and a first stapling process executed by stapler 150. At this time, second feeding member 172 functions as the positioner for positioning the pile of sheets at the saddle-stitching position where the saddle-stitching is executed by stapler 150.

Figure 14B:
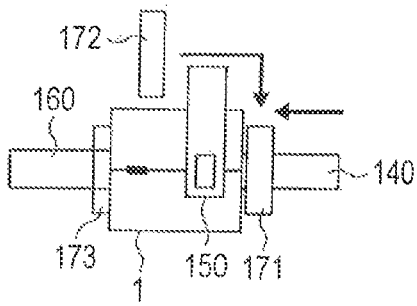
FIG. 14B is a top view describing the operation of the saddling mechanism and the saddle-stitching mechanism, and shows a second state of the operation.

Next, as shown in FIG. 14B, sheets 1 are moved in second direction D2 by pushing the rear end of sheets 1 by first feeding member 171. At this time, positioning member 173 is moved to the front end side of sheets 1, and sheets 1 are positioned by first feeding member 171 and positioning member 173 at a second staple position, and a second stapling process is performed at this position. Furthermore, part of the front end side of sheets 1 is placed on buffer saddle 160 while the second stapling process is being performed. In this configuration, in the saddle-stitching of sheets 1 conducted by moving sheets 1 to fixed stapler 150, main saddle 140 and buffer saddle 160 share the sheet placing operation, which allows a reduction in the length of main saddle 140.

As shown in the drawing, after completing the positioning at the first staple position, second feeding member 172 avoids main saddle 140, and then moves behind the rear end side of sheets 1.

Figure 14C:
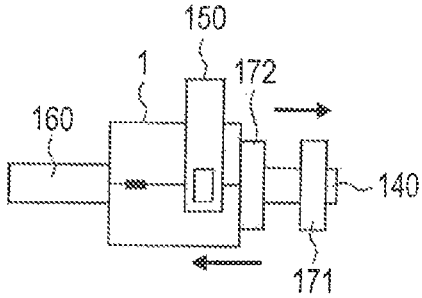
FIG. 14C is a top view describing the operation of the saddling mechanism and the saddle-stitching mechanism, and shows a third state of the operation.

Next, as shown in FIG. 14C, a saddle-stitched booklet is pushed at the rear end by second feeding member 172, and is moved toward buffer saddle 160. When this occurs, first feeding member 171 retracts backwards in order to receive the next sheet 1.

Figure 14D:
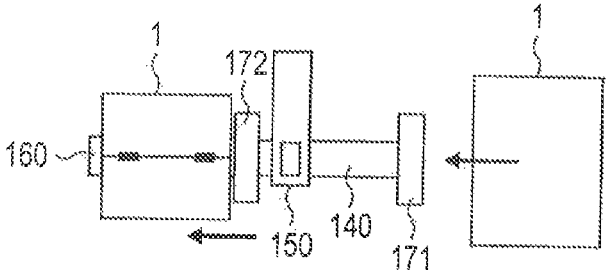
FIG. 14D is a top view describing the operation of the saddling mechanism and the saddle-stitching mechanism, and shows a fourth state of the operation.

Then, as shown in FIG. 14D, sheets (referred to as pile of sheets or booklet) 1 are held between second feeding member 172 and positioning member 173, and are brought into a state of being completely placed on buffer saddle 160. When this occurs, buffer saddle 160 is in an independently movable state with the pile of sheets 1 placed thereon, and main saddle 140 is able to receive the next sheet 1.

Figure 14E:
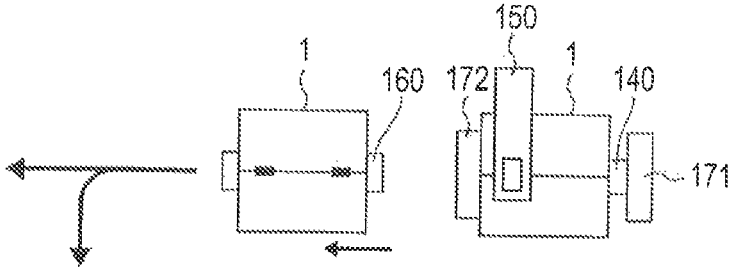
FIG. 14E is a top view describing the operation of the saddling mechanism and the saddle-stitching mechanism, and shows a fifth state of the operation.

Next, as shown in FIG. 14E, buffer saddle 160 feeds the pile of sheets 1 to the next processing position (cutter 180) with the pile of sheets 1 placed on buffer saddle 160. Meanwhile, the next sheets 1 are placed on main saddle 140, and the saddle-stitching process is started.

When feeding the pile of sheets 1 to cutter 180 (cutting section) with the pile of sheets 1 placed on buffer saddle 160, buffer saddle 160 moves in direction D2 separating from main saddle 140, and then moves in direction D3 orthogonal to the direction separating from main saddle 140. In other words, buffer saddle 160 moves along a right-angled path. On the other hand, when delivering the pile of sheets 1 to cutter 160 and thereafter returning to a receiving position for receiving the pile of sheets 1 from main saddle 140, buffer saddle 160 moves linearly from a delivering position to cutter 180, to the receiving position from main saddle 140. Specifically, a motor (not shown) activates drive belt 162 and drive belt 165 at the same time. Accordingly, buffer saddle 160 can rapidly return to the position where the pile of sheets 1 is received from main saddle 140.

(2-3) Configurations of Cutter, Sheet Tray and Lifter

Figure 15:
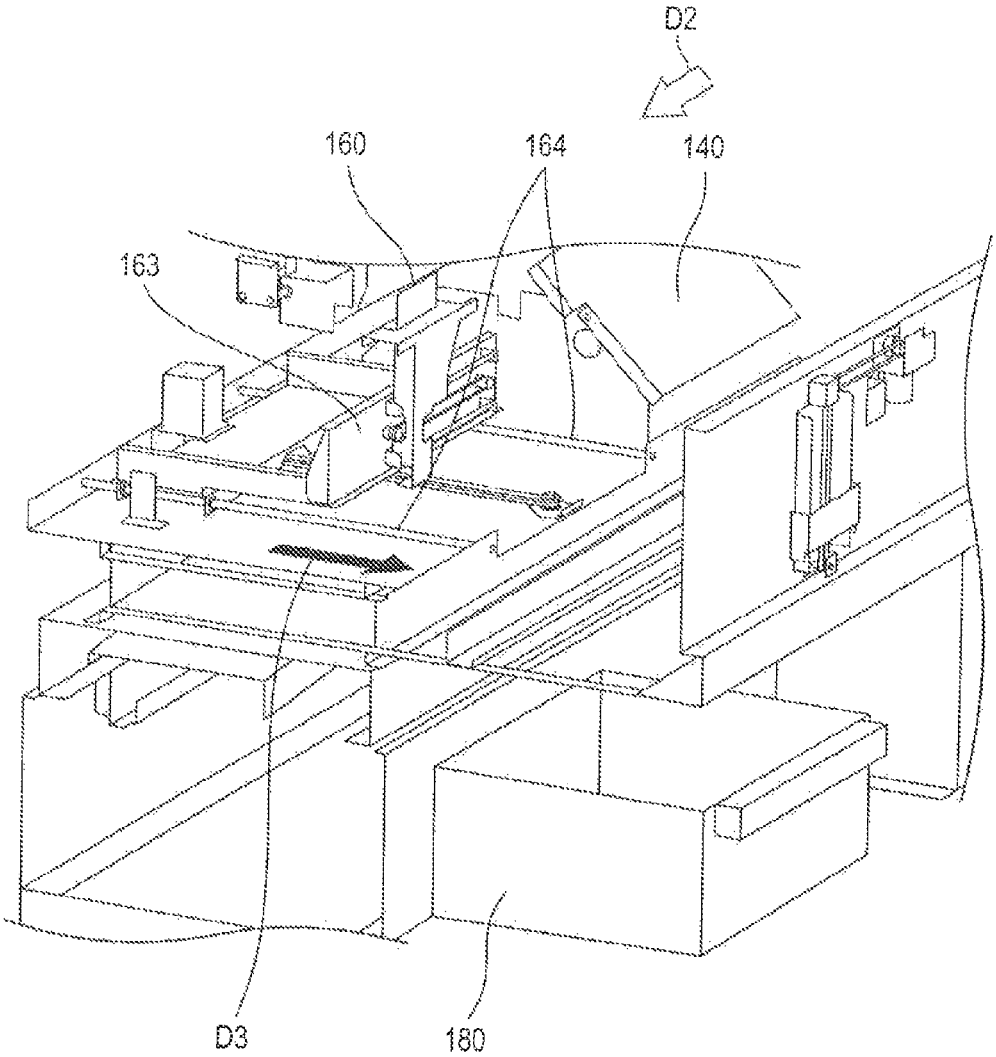
FIG. 15 is a diagram showing an arrangement of a cutter.

As shown in FIG. 15, cutter 180 is arranged in direction D3, which is the direction that buffer saddle 160 moves. Cutter 180 includes a cutter blade (not shown), and cuts an edge portion opposite the saddle-stitched side of a saddle-stitched sheets.

Figure 16:
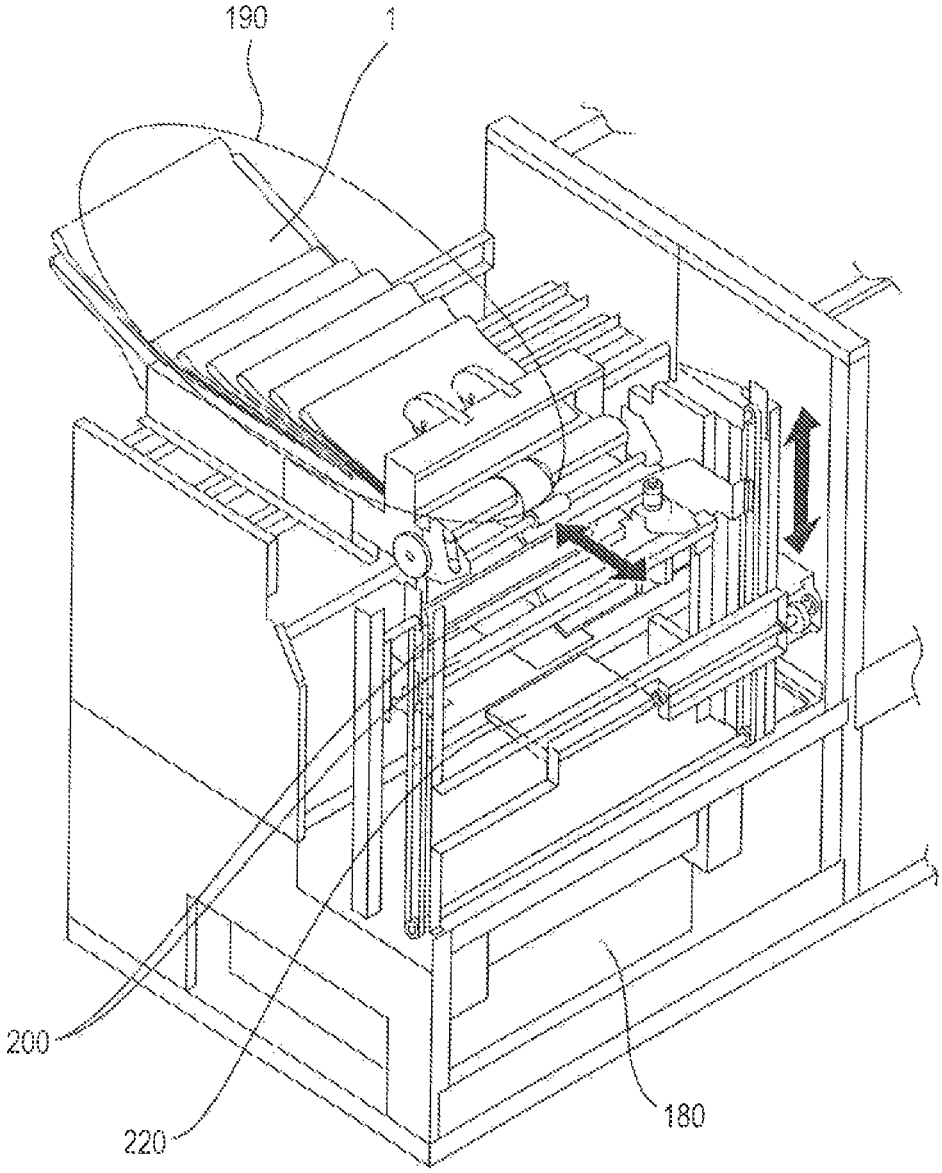
FIG. 16 is a perspective view showing an arrangement of the cutter, an ejected sheet tray and a lifter.

FIG. 16 shows the arrangement of the cutter, the sheet tray and the lifter. Cutter 180 is arranged at a position below buffer saddle 160. Ejected sheet tray 190 is arranged above cutter 180. In the present embodiment, ejected sheet tray 190 is provided above second sheet processor 100. Lifter 200 receives a saddle-stitched pile of sheets from buffer saddle 160, lowers the sheets to cutter 180 in a vertically held state, and raises the pile of sheets from cutter 180 to ejected sheet tray 190.

Accordingly, arranging ejected sheet tray 190 above buffer saddle 160 and cutter 180 allows a user to easily take the booklet (pile of sheets). Moreover, the installation area of the device can be miniaturized.

Figure 17:
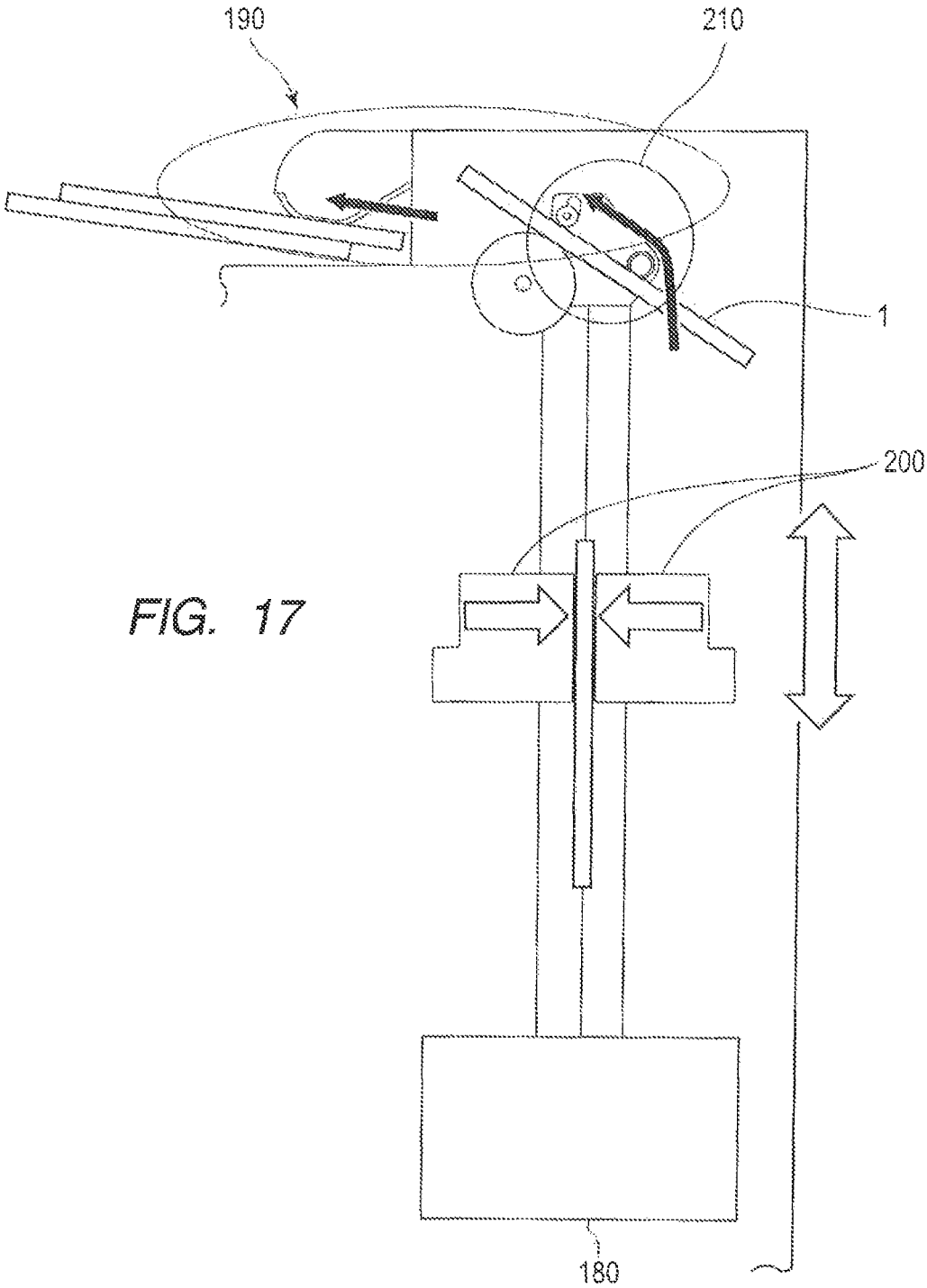
FIG. 17 is a side view showing an arrangement of the cutter, the ejected sheet tray and the lifter.
Figure 18:
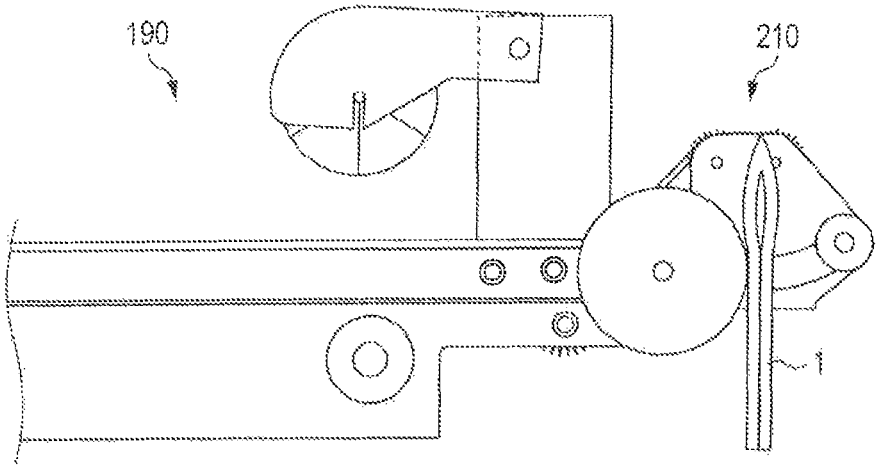
FIG. 18 is a side view describing a direction changer.
Figure 19:
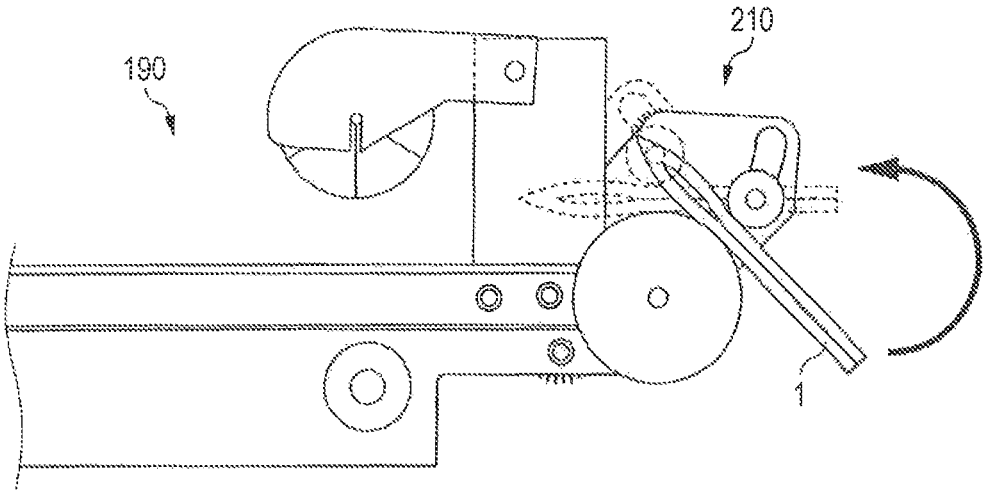
FIG. 19 is a side view describing the direction changer.

As shown in FIGS. 17, 18 and 19, direction changer 210 is provided at the opening of ejected sheet tray 190. Direction changer 210 is a clamping mechanism, which changes the direction of the pile of sheets 1 that is vertically held by lifter 200 so as to be substantially horizontal, and places the pile of sheets 1 on ejected sheet tray 190.

Figure 20:
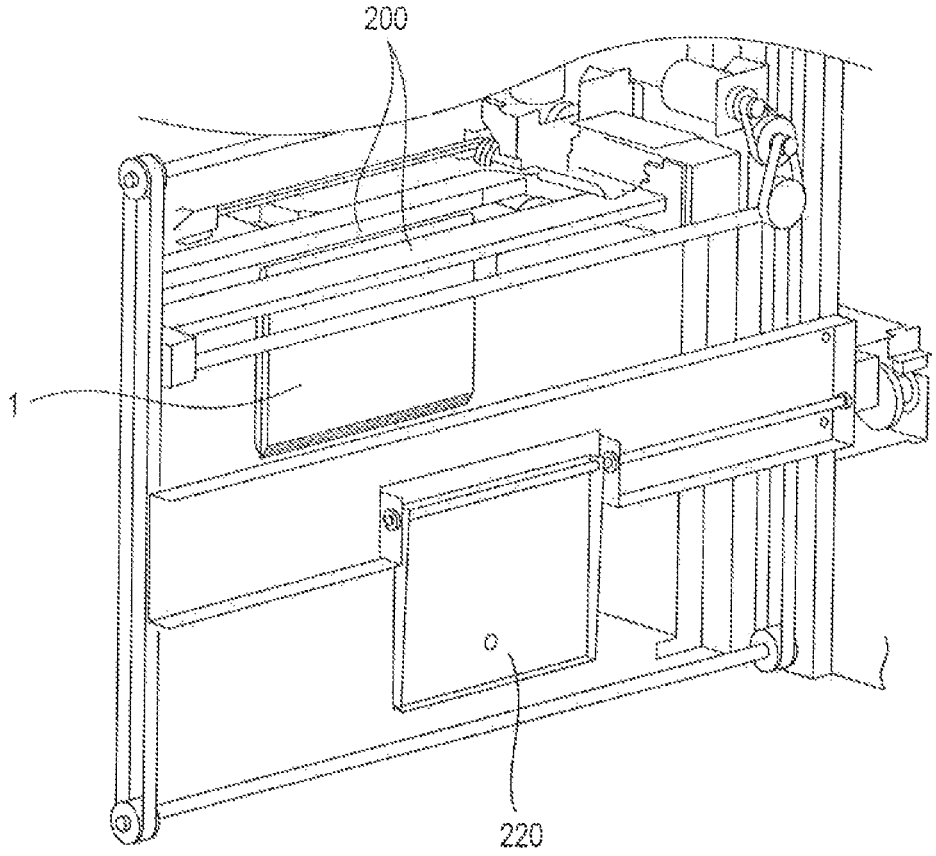
FIG. 20 is a perspective view describing a change in the holding position of the lifter.
Figure 21:
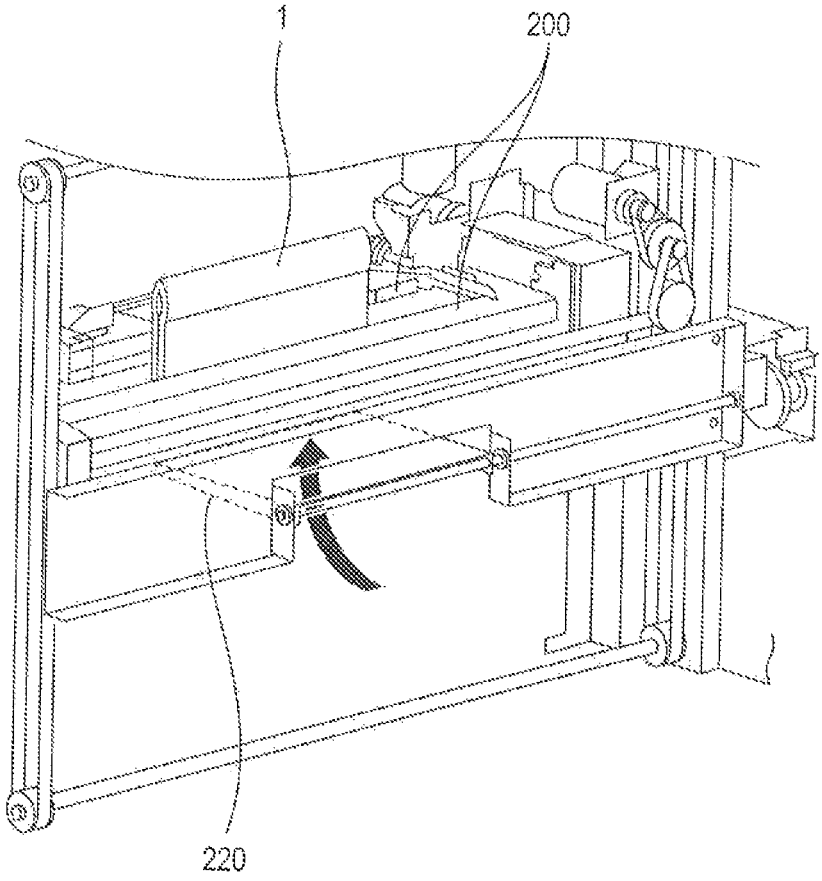
FIG. 21 is a perspective view describing a change in the holding position of the lifter.

As shown in FIGS. 20 and 21, lifter 200 can change the position of holding the pile of sheets 1 between a first holding position and a second holding position which is lower than the first holding position. Lifter 200 changes the position of holding the pile of sheets 1 from the first holding position to the second holding position when the pile of sheets 1 is raised from cutter 180 to ejected sheet tray 190.

In the present embodiment, retaining plate 220 is provided in order to change the holding position.

Figure 22:
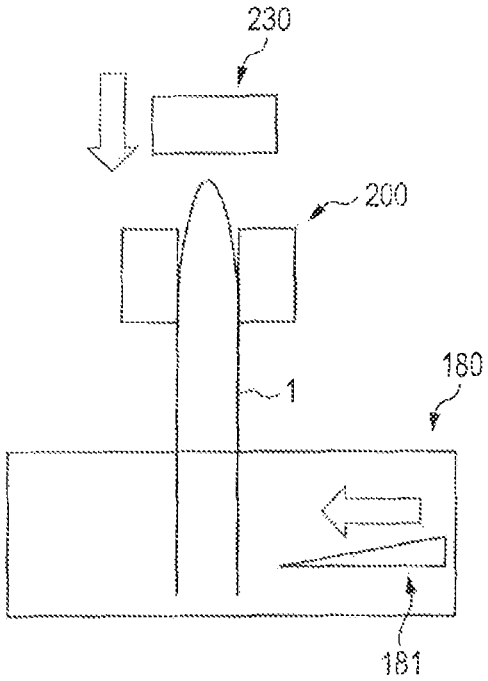
FIG. 22 is a diagram describing a square-folding process.

An operation will be described. First, lifter 200 performs a square folding process via square folding member 230, as shown in FIG. 22, while holding an upper end proximity (the fold) of the pile of sheets 1, as shown in FIG. 20, then the pile of sheets 1 is lowered onto cutter 180, and a cutting process is performed by cutter blade 181 of cutter 180. Afterwards, the cut pile of sheets 1 is raised. At this time, retaining plate 220 is in a vertical state, as shown in FIG. 20.

Then, after lifter 200 is raised to a certain position, retaining plate 220 is rotated so as to be in a horizontal state, as shown in FIG. 21, and the pile of sheets 1 is placed on the top surface of retaining plate 220. Accordingly, lifter 200 changes the holding position to the second holding position below the first holding position while the pile of sheets 1 is retained in retaining plate 220.

Holding the upper end proximity (the fold) of the pile of sheets 1 and accurately closing the pile of sheets 1 allows an accurate square folding process and a cutting process to be performed. Moreover, changing the holding position to the second holding position lower than the first holding position allows direction changer 210 positioned above cutter 180 to appropriately receive the pile of sheets 1.

As described above, according to the present embodiment, there are provided: main saddle 140 receiving the sheets center-folded by center-folder 130, and having these center-folded sheets placed thereon; buffer saddle 160 provided separately from main saddle 140, disposed on the opposite side of center-folder 130 across main saddle 140, allowing the pile of sheets 1 saddle-stitched on main saddle 140 to be placed thereon, and movable in the direction D2 separating from main saddle 140 that is the reverse direction to center-folder 130 and also in the direction D3 orthogonal to the direction separating from main saddle 140, viewed from above; and cutter 180 arranged in the orthogonal direction D3 where buffer saddle 160 is movable.

While the folding direction of the center-folded pile of sheets 1 is fixed, the pile of sheets 1 is fed all the way from center-folder 130 through main saddle 140 and buffer saddle 160 to cutter 180.

Accordingly, the process from the saddle-stitching to the cutting is carried out without changing the position of the pile of sheets 1, thereby eliminating space for changing the sheet position as well as a complicated configuration required for changing the sheet position. As a result, it is possible to provide the sheet processing device (second sheet processor 100) having a simple configuration and a small size.

Cutter 180 is arranged not in series with center-folder 130, main saddle 140, and buffer saddle 160, but in parallel to buffer saddle 160, thereby preventing the device from being elongated in the direction D2 in series with center-folder 130, main saddle 140, and buffer saddle 160. Buffer saddle 160 is shorter than main saddle 140 in the direction D3. Therefore, even if buffer saddle 160 is arranged in parallel to cutter 180, their combined length is substantially covered by the length of main saddle 140. As described above, the sheet processing device (second sheet processor 100) is excellent in balance of arrangement in the device, which reduces overall installation area of the device.

Main saddle 140 carries out the saddle-stitching process, and buffer saddle 160 carries out the feeding process of the pile of sheets 1. Consequently, the configuration of the saddle mechanism required to perform both the saddle-stitching and the feeding of the sheets can be simplified, and the processing can be achieved at a high speed.

Arranging ejected sheet loader 190 above buffer saddle 160 and cutter 180 allows a user to easily remove the booklet (pile of sheets). Moreover, the installation area of the device can be miniaturized.

In the abovementioned embodiment, such a case has been described that cutter 180 is provided as a post processor for performing the post-processing on the pile of sheets 1 in the orthogonal direction D3 where buffer saddle 160 is movable; but the present invention is not limited to this case, and a square fold processor or the like may be provided instead of cutter 180.

An invention made by the present inventor has been specifically described above based on an exemplary embodiment. However, the present invention is not limited to the embodiment described above, and changes can be made without departing from the spirit of the invention. The embodiment disclosed herein is exemplary in every aspect, and therefore not understood to be restrictive. The scope of the present invention is indicated not by the description above, but by the appended claims, and all modifications equivalent in meaning and scope to the claims fall within the scope of the claimed invention.

What is claimed is:

1. A sheet processing device comprising:

a first saddle on which sheets center-folded by a center-folder are to be placed;

a second saddle that is provided separately from the first saddle, is disposed on a side of the first saddle that is opposite from the center-folder, allows a pile of sheets saddle-stitched on the first saddle to be placed thereon, and is movable in a direction separating from the first saddle that is a reverse direction to the center-folder and in a direction orthogonal to the direction separating from the first saddle, viewed from above; and a post processor that is arranged in the orthogonal direction where the second saddle is movable, and performs a post-processing on the pile of sheets.

2. The sheet processing device according to claim 1, wherein while a folding direction of the center-folded pile of sheets is fixed, the pile of sheets are moved from the center-folder through the first saddle and the second saddle to the post processor.

3. The sheet processing device according to claim 1, wherein when the second saddle feeds the pile of sheets to the post processor with the pile of sheets placed on the second saddle, the second saddle moves in the direction separating from the first saddle, and thereafter moves in the direction orthogonal to the direction separating from the first saddle, and when the second saddle delivers the pile of sheets to the post processor and thereafter returns to a receiving position for receiving the pile of sheets from the first saddle, the second saddle moves linearly from a delivering position to the post processor, to the receiving position from the first saddle.

4. The sheet processing device according to claim 1, wherein the post processor includes a cutter that trims an edge portion of the pile of sheets.

5. The sheet processing device according to claim 1, wherein a sheet loader that loads the pile of sheets post-processed by the post processor is arranged above the second saddle.

6. An image forming system comprising:

an image forming unit that forms an image on a sheet; and the sheet processing device according to claim 1 that receives the sheet on which the image is formed by the image forming unit.

* * * * *